US006866945B2

(12) United States Patent
Kuo et al.

(10) Patent No.: US 6,866,945 B2
(45) Date of Patent: Mar. 15, 2005

(54) MAGNESIUM CONTAINING ALUMINUM ALLOYS AND ANODIZING PROCESS

(75) Inventors: Hong-Hsiang Kuo, Troy, MI (US); Yar-Ming Wang, Troy, MI (US); Sheila Farrokhalaee Kia, Bloomfield Hills, MI (US)

(73) Assignee: General Motors Corporation, Detroit, MI (US)

( * ) Notice: Subject to any disclaimer, the term of this patent is extended or adjusted under 35 U.S.C. 154(b) by 137 days.

(21) Appl. No.: 10/336,959

(22) Filed: Jan. 6, 2003

(65) Prior Publication Data

US 2005/0031856 A1 Feb. 10, 2005

(51) Int. Cl.[7] ..... B32B 15/20; C25D 5/34

(52) U.S. Cl. ..... 428/650; 428/640; 428/654; 428/687; 428/697; 428/702; 428/319.1; 428/314.8; 205/205; 205/201; 205/219; 205/328

(58) Field of Search ..... 205/205, 201, 205/219, 328; 428/640, 650, 654, 687, 697, 702, 935, 307.3, 319.1, 314.8, 409

(56) References Cited

U.S. PATENT DOCUMENTS

| | | | | |
|---|---|---|---|---|
| 3,761,362 | A | | 9/1973 | Oida et al. |
| 4,022,671 | A | * | 5/1977 | Asada ..... 205/174 |
| 4,601,796 | A | | 7/1986 | Powers et al. |
| 4,806,211 | A | | 2/1989 | Timm et al. |
| 5,948,542 | A | * | 9/1999 | Le et al. ..... 428/472.2 |
| 6,309,427 | B1 | * | 10/2001 | Korte ..... 8/685 |
| 6,322,689 | B1 | * | 11/2001 | Omasa ..... 205/324 |

* cited by examiner

*Primary Examiner*—Deborah Jones
*Assistant Examiner*—Ling X. Xu
(74) *Attorney, Agent, or Firm*—Kathryn A. Marra

(57) ABSTRACT

An anodized aluminum alloy comprises an aluminum alloy comprising magnesium in an amount greater than 3 weight percent based on the total weight of the aluminum alloy; and a clear porous oxide layer having a thickness greater than about 5 micrometers disposed on and into a surface of the aluminum alloy, wherein the anodized aluminum alloy has a surface gloss value greater than about 40 gloss units as measured on a gloss meter at dual illumination angles of 60° and 85°.

12 Claims, No Drawings

MAGNESIUM CONTAINING ALUMINUM ALLOYS AND ANODIZING PROCESS

BACKGROUND

This disclosure relates generally to aluminum alloys and more particularly, to aluminum alloys containing magnesium, and processes for anodizing the magnesium containing aluminum alloys.

It is well known that aluminum alloys are susceptible to corrosion. For maximum corrosion resistance, it is now almost universally accepted to anodize aluminum by using a sulfuric acid solution followed by a sealing operation that typically employs a chromated solution, a nickel acetate solution, and/or by sealing the aluminum workpiece in a bath of boiling distilled water. One such anodizing process is defined by the U.S. government in MIL-A-8625 and is also commonly referred to as Type II anodizing. The Type II anodizing process applied to aluminum and aluminum alloys produces a porous oxide coating that is about 0.001 to about 0.0003 inches thick and has a typical coating weight of about 1,000 mg/ft$^2$. The coating thickness of the oxide layer is generally a combination of both penetration into the surface of the aluminum and build-up onto the surface, in approximately a 1:1 ratio. The resulting oxide coating provides corrosion resistance, abrasion resistance, hardness, aesthetic features, and other special electrical and mechanical properties.

Type II anodizing processes are generally formed by using an electrolytic solution of sulfuric acid at about room temperature and applying a steady state direct current density of at least about 15 amperes per square foot. The process will typically run for about 30 to about 180 minutes depending on the type of aluminum alloy used.

Aluminum and aluminum alloys are generally classified with a four-digit system that is based upon the principal alloying element. For example, the 5000 series generally refers to aluminum alloys that contain magnesium as the principal alloying additive whereas the 6000 series refers to aluminum alloys that contain both magnesium and silicon as the principal alloying additives.

The amount of alloying additive present in the aluminum alloy is generally known to affect the coating quality of the anodizing process. For example, the porous oxide layer produced by anodizing aluminum in sulfuric acid is completely transparent and colorless when produced on high purity aluminum or on aluminum-magnesium alloys or aluminum-magnesium-silicon alloys based on high purity aluminum (aluminum purity greater than or equal to about 97 weight percent). However, when the aluminum is of lower purity, i.e., less than about 97 weight percent aluminum, the resulting anodized film is colored and exhibits low gloss. For example, standard Type II anodizing of a 5000 series aluminum alloy, wherein the magnesium is greater than 3 weight percent, results in a discolored coating. Typically, the discoloration will be gray in color, which is generally dependent on the amounts of alloying additive contained in the aluminum metal. The severity of the discoloration will detract from the aesthetic qualities of the anodized coating and may prevent color finishing through color anodizing techniques such as by addition of pigments or dyes, or by electrodeposition of metals to the base of the pores. Color finishing through color anodizing techniques imparts a very decorative finish both in a satin and a polished surface result.

Also, when anodizing aluminum alloys containing greater than 3% magnesium there is a reduction in surface gloss.

Studies suggest that surface roughness increases during the anodizing process because magnesium reacts faster than aluminum in the sulfuric acid anodizing bath. At magnesium alloy additive levels less than 3%, the effect on surface roughness (gloss) is minimal and less pronounced. However, aluminum alloys containing magnesium alloying additive levels greater than 3%, the effect on gloss is more pronounced. Reducing the initial surface roughness of the aluminum alloy part to be anodized fails to compensate for the reduction in gloss. For example, conventionally anodizing (Type II) an aluminum alloy containing about 5% magnesium at a current density of 15 amperes per square foot that had been mechanically polished to a surface roughness less than about 100 nanometers resulted in a 20-micrometer thick oxide film exhibiting a surface roughness of about 500 nanometers. The resulting aluminum alloy oxide layer was grayish in color and exhibited low gloss characteristics.

BRIEF SUMMARY

Disclosed herein is magnesium containing aluminum alloy and anodizing process for producing bright finishes. The anodized aluminum alloy comprises an aluminum alloy comprising magnesium in an amount greater than 3 weight percent based on the total weight of the aluminum alloy; a clear porous oxide layer having a thickness greater than about 5 micrometers disposed on and into a surface of the aluminum alloy, wherein the anodized aluminum alloy has a surface gloss value greater than about 40 gloss units as measured on a gloss meter at dual illumination angles of 60° and 85°.

In another embodiment, the anodized aluminum alloy comprises an aluminum alloy consisting essentially of aluminum and magnesium, wherein the magnesium is in an amount greater than 3 weight percent of the aluminum alloy with a remainder being the aluminum; a clear porous oxide layer having a thickness greater than about 5 micrometers disposed on and into a surface of the aluminum alloy, wherein the anodized aluminum alloy has a surface gloss value greater than about 40 gloss units as measured on a gloss meter at dual illumination angles of 60° and 85°.

A process for anodizing an aluminum alloy comprises immersing an aluminum alloy workpiece comprising greater than 3 weight percent magnesium based on a total weight of the aluminum alloy into an anodizing solution consisting essentially of about 10 to about 25 weight percent sulfuric acid maintained at a temperature of about 18° C. to about 22° C.; applying a first direct electric current density less than or equal to about 5 amperes per square foot for a period of time sufficient to produce an oxide layer at a thickness of at least about 5 micrometers on and into a surface of the aluminum alloy workpiece; and applying a subsequent direct electric current density greater than or equal to about 10 amperes per square foot for a period of time sufficient to produce a final oxide thickness of about 10 micrometers to about 25 micrometers, wherein the oxide layer is clear and the aluminum alloy workpiece has a gloss value greater than 40 gloss units as measured by a gloss meter at dual illumination angles of 60° and 85°.

In another embodiment, an anodizing process comprises immersing an aluminum alloy workpiece comprising greater than 3 weight percent magnesium based on a total weight of the aluminum alloy into an anodizing solution comprising about 10 to about 25 weight percent sulfuric acid maintained at a temperature of about 18° C. to about 22° C.; applying a first direct electric current density to produce an oxide layer at a thickness of at least about 5 micrometers on and into a surface of the aluminum alloy workpiece; and applying a subsequent direct electric current density to produce a final oxide thickness of about 10 micrometers to about 25 micrometers, wherein the first direct electric current density is less than the subsequent direct electric current density, and wherein the oxide layer is clear and the aluminum alloy workpiece has a gloss value greater than 40 gloss units as measured by a gloss meter at dual illumination angles of 60° and 85°.

The above described and other features are exemplified by the following detailed description.

DETAILED DESCRIPTION

Disclosed herein is an anodizing process for producing bright anodized finishes to aluminum alloys that contain magnesium. The anodizing process generally includes applying a stepped current in a sulfuric acid anodizing bath to control the quality of the coating. The anodizing process can be used to produce both clear coatings and colored coatings while providing high gloss to the finish.

The aluminum alloys for use in the anodizing process contain greater than 3 weight percent magnesium based on the total weight of the aluminum alloys. The aluminum alloys may consist essentially of greater than 3 weight percent magnesium with the balance being aluminum or may contain other alloying additives such as silicon. Suitable aluminum alloys that contain magnesium as an alloying additive in amounts greater than 3 weight percent include those generally classified as series 5000 and series 6000 type aluminum alloys.

Prior to anodizing, the aluminum alloy part or workpiece is preferably vapor degreased or acid cleaned to remove any cutting oils or protective greases that may be on the surfaces of the aluminum alloy workpiece. Such contaminants can be removed by vapor degreasing using such materials as 1,1,1 trichloroethane, trichloroethylene, or perchloroethylene. In the event that the aluminum alloy workpiece as received does not have this type of contamination, then this step may be omitted.

The degreased aluminum alloy workpieces are then transferred to an alkaline cleaning solution to remove various other contaminants that are often referred to as shop dirt. The alkaline cleaning solution can include various sodium salts with multiple surfactants, synthetic detergents, emulsifiers, flocculents, wetting agents and the like. For example, a suitable alkaline cleaner solution comprises trisodium phosphate at a concentration of about 5 grams per liter. The cleaning of the aluminum alloy workpieces is most effectively conducted with the alkaline cleaner solution being well agitated and being maintained at an elevated temperature. Preferably, the temperature of the alkaline cleaner solution is maintained at about 20° centigrade (C) to about 79° C. The immersion time for the aluminum alloy workpieces in the alkaline cleaner solution is preferably about 0.1 to about 30 minutes, with an immersion time of about 1 to about 10 minutes more preferred, which step is then followed by rinsing the aluminum alloy workpieces in hot water to remove all traces of the cleaner and the removed dirt.

The aluminum alloy workpiece may then be subjected to a brightening or bright dip operation by immersing the aluminum alloy workpiece into a hot aqueous solution containing a mixture of nitric, phosphoric, and sulfuric acids. A suitable mixture is one containing, by weight, about 3% nitric acid, about 78% to about 80% phosphoric acid, about 1% sulfuric acid, and about 17% to about 19% distilled water. This mixture is preferably held at an elevated temperature. Preferably, the temperature of the bright dip solution is about 10° C. to about 95° C., with about 38° C. to about 95° C. more preferred, and with about 65° C. to about 95° C. even more preferred. The aluminum alloy workpiece is preferably immersed in the bright dip solution for at least about 2 minutes, and preferably up to about 10 minutes. The aluminum alloy workpiece is then rinsed with deionized water.

The metal is then dipped in a desmutting or deoxidizing bath, rinsed with deionized water, and dried. The desmutting or deoxidizing bath removes any oxide particles, intermetallics, silicon, etc., which are insoluble in alkaline solution, and are loosely held on the aluminum alloy workpieces. Such baths may include non-smutting acid solutions such as aqueous mixtures of chromic and sulfuric acids, chromic and nitric acids, ferric sulfate/nitric/sulfuric acids, and the like. The immersion time of the aluminum alloy workpieces in the desmutting/deoxidizing bath is based on the etch rate for the particular deoxidizer solution employed. The aluminum workpieces are then suitably rinsed with water to remove any residue of the deoxidizing agent. Suitable deoxidizer-desmutter solutions not only must remove smut and deoxidize the aluminum, but must also not have a detrimental effect on the aluminum alloy surface with extended immersion times.

The aluminum alloy workpiece is then subjected to a direct current (DC) anodizing process in a sulfuric acid bath using the aluminum alloy workpiece as the anode. In a preferred embodiment, the current density is stepped, wherein a first step current density is preferably less than a subsequent step current density. While not wanting to be bound by theory, it is believed that forming the first few microns of oxide coating at the low current density, i.e., first step current density, a diffusion barrier is formed which permits subsequent anodizing of the magnesium containing aluminum alloy to proceed at higher current densities with minimal impact on surface gloss. As noted in the background section, anodizing with initially high current densities, i.e., greater than 10 amperage per square foot ($A/ft^2$), impacts the surface gloss property of the aluminum alloy workpiece. Thus, the process can be used to provide a clear, colorless coating to the aluminum alloy workpiece within a reasonable process time. As used herein, the term "clear" is hereinafter defined as an anodized coating without the subsequent coloring step. In a preferred embodiment, the first step current density produces about 5 micrometers of oxide onto and into the aluminum alloy surface.

The first step current density is preferably less than or equal to about 5 $A/ft^2$. The subsequent step current density is preferably greater than or equal to about 10 $A/ft^2$, with greater than or equal to about 12 $A/ft^2$ more preferred, and with greater than or equal to about 15 $A/ft^2$ even more preferred.

The anodizing time for the first and subsequent steps preferably provides total amperage minutes per square foot ($A.min/ft^2$) of about 300 $A.min/ft^2$ to about 800 $A.min/ft^2$, and with total amperage minutes per square foot of about 400 $A.min/ft^2$ to about 600 $A.min/ft^2$ even more preferred. Individually, it is preferred that the total amperage minutes per square foot of the first step subsequent step is less than about 400 $A.min/ft^2$, with less than about 300 $A.min/ft^2$ more preferred, and with less than about 200 $A.min/ft^2$ even more preferred.

With respect to the time of the anodizing process steps, it is preferred that the duration of the first step is less than about 120 minutes, with less than about 60 minutes more preferred and with less than about 40 minutes even more preferred. Similarly, it is preferred that the subsequent steps are less than about 120 minutes, with less than about 60 minutes more preferred and with less than about 40 minutes even more preferred. The entire anodizing process is preferably less than about 180 minutes, with less than about 120 minutes more preferred, with less than about 100 minutes even more preferred, and with less than about 75 minutes most preferred.

The sulfuric acid anodizing bath preferably has a concentration of sulfuric acid of about 10 to about 25 weight percent (wt %), with a concentration of about 12 to about 18 wt % even more preferred. The temperature of the bath during anodizing is preferably maintained at about 15° C. to about 30° C., with a temperature of about 18° C. to about 22° C. more preferred, and with a temperature of about 20° C. (room temperature) even more preferred.

The thickness of the porous oxide layer formed during the anodizing process depends on factors such as anodizing time, current density, and electrolyte temperature. Generally, the higher the current density and electrolyzing time, the greater the thickness of the porous oxide layer. In other words, the greater the electric charge (current density× electrolyzing time), the greater is the thickness of the porous layer. The temperature can be used to control the hardness of the film. Generally, if the temperature of the electrolytic bath is low, a hard oxide film can be formed. Preferably, the thickness of the porous oxide layer formed during the anodizing process is about 5 micrometers to about 50 micrometers, with about 10 micrometers to about 25 micrometers more preferred and with about 12 micrometers to about 17 micrometers even more preferred.

The anodized aluminum alloy can then be rinsed in water and may optionally be sealed by immersion in hot (about 90° to about 100° C.) deionized water or a nickel acetate solution for about 5 minutes and then removed and dried. Other more involved sealing techniques may be used, but may not be necessary.

Alternatively, the anodized aluminum alloy may be subjected to a coloring process and then sealed. For example, the anodized aluminum alloy workpiece can be immersed in a tin sulfate solution and connected to a negative terminal of the power supply. In this manner, tin metal is plated at the base of the oxide pores to provide varying colors depending on plating time, e.g., light bronze to black. The anodized aluminum alloy workpiece may also be colored by dipping into a dye containing solution to produce a variety of colors. However, this coloring process is less desirable since most dyes exhibit some degree of fading or bleaching upon exposure to light sources such as sunlight.

The gloss may then be measured to provide an indication of the brightness provided by the process. Preferably, the gloss of the anodized aluminum alloy is measured by a gloss meter at dual illumination angles of 60 degrees and 85 degrees and is greater than about 40 gloss units (GU), with greater than about 50 GU even more preferred, and with greater than about 60 GU most preferred.

The disclosure is further illustrated by the following non-limiting Examples.

EXAMPLE 1

In this example, sample panels of 5083-type aluminum alloy were anodized in a sulfuric acid bath The 5083-type aluminum alloy contained about 4.6% magnesium as an alloying additive with the remainder aluminum. The anodizing process included applying a stepped DC current density for a predetermined time as shown in Table 1. The sulfuric acid bath included a concentration of 160 grams per liter and was maintained at a temperature of about 20° C. Gloss was measured using a portable Micro-TRI gloss meter commercially available from the BYK-Gardner GmbH Company. Gloss readings were measured at dual illumination angles of 60° and 85°, wherein the illumination angle is defined as the angle between the axis perpendicular to the sample surface and directed light. The directed light reflected from the surface was measured photo-electrically and described by the reflectometer value R. This is a relative measurement based on the gloss value of 100 for a highly polished black glass plate standard with a refractive index of 1.567. The panels were also qualitatively inspected for clarity.

Prior to anodizing, the aluminum alloy was polished, alkaline cleaned, bright dipped, and deoxidized. After anodizing, the aluminum alloy workpiece was sealed. The results are shown in Table 1.

TABLE 1

| Test Panel | Two Step Anodizing | Total Charge (A.minutes/ft$^2$) | Thickness (micro-meters) | Gloss @ 60° | Clarity |
|---|---|---|---|---|---|
| A | a) 40 minutes @ 5 A/ft$^2$ b) 30 minutes @ 10 A/ft$^2$ | 500 | 14.57 | 74 | Clear |
| B | a) 40 minutes @ 5 A/ft$^2$ b) 20 minutes @ 15 A/ft$^2$ | 500 | 15.76 | 42 | Clear |
| C | a) 40 minutes @ 5 A/ft$^2$ b) 10 minutes @ 20 A/ft$^2$ | 400 | 12.37 | 48 | Clear |
| D | a) 60 minutes @ 3 A/ft$^2$ b) 30 minutes @ 10 A/ft$^2$ | 480 | 13.12 | 35 | Clear |
| E | a) 60 minutes @ 3 A/ft$^2$ b) 20 minutes @ 15 A/ft$^2$ | 480 | 13.83 | 46 | Clear |
| F | a) 60 minutes @ 3 A/ft$^2$ b) 10 minutes @ 20 A/ft$^2$ | 380 | 10.80 | 54 | Clear |
| G* | 40 minutes @ 15 A/ft$^2$ | 600 | N/A | 40 | Light gray; hazy |

*CONTROL

The results of the stepped anodizing process clearly show improved gloss values relative to the control. Gloss values as high as 74 GU were obtained for the stepped process. Moreover, the stepped process resulted in consistently clear oxide coatings within a reasonable process time, thereby providing a significant commercial advantage.

EXAMPLE 2

In this example, sample panels of 5083-type aluminum alloy were anodized in a sulfuric acid bath. After anodizing, the panels were immersed in a tin sulfate/sulfuric acid solution and connected to the negative terminal of the power supply. The electrolytic coloring (EC) solution contained tin sulfate at a concentration of 4 grams per liter and sulfuric acid at a concentration of 15 grams per liter. The results are shown in Table 2.

TABLE 2

| Test Panel | Two Step Anodizing | Total Charge (A.minutes/ft$^2$) | Thickness (micrometers) | Gloss @ 60° | EC Coloring (seconds) | Clarity |
|---|---|---|---|---|---|---|
| H | a) 40 min @ 5 A/ft$^2$ b) 30 min @ 10 A/ft$^2$ | 500 | 15.15 | 82.80 | 0 | Clear |
| I | a) 40 min @ 5 A/ft$^2$ b) 30 min @ 10 A/ft$^2$ | 500 | 15.27 | 72.07 | 5 | Clear |
| J | a) 40 min @ 5 A/ft$^2$ b) 30 min @ 10 A/ft$^2$ | 500 | 14.79 | 69.03 | 10 | Clear |
| K | a) 40 min @ 5 A/ft$^2$ b) 30 min @ 10 A/ft$^2$ | 500 | 15.38 | 65.97 | 20 | Clear |
| L | a) 40 min @ 5 A/ft$^2$ b) 30 min @ 10 A/ft$^2$ | 500 | 15.58 | 61.83 | 60 | Clear |

The results show that the anodizing process produced a clear oxide layer even after coloring for extended periods of time. Moreover, the gloss values were advantageously greater than 60 GU, even after extended electrocoloring processing times.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. An anodized aluminum alloy comprising:

an aluminum alloy comprising magnesium in an amount greater than 3 weight percent based on the total weight of the aluminum alloy; and a clear porous oxide layer having a thickness greater than about 5 micrometers disposed on and into a surface of the aluminum alloy, wherein the anodized aluminum alloy has a surface gloss value greater than about 40 gloss units as measured on a gloss meter at dual illumination angles of 60° and 85°.

2. The anodized aluminum alloy according to claim 1, wherein the surface gloss value is greater than about 50 gloss units as measured on the gloss meter at the dual illumination angles of 60° and 85°.

3. The anodized aluminum alloy according to claim 1, wherein the surface gloss value is greater than about 60 gloss units as measured on the gloss meter at the dual illumination angles of 60° and 85°.

4. The anodized aluminum alloy according to claim 1, wherein the thickness of the clear porous oxide layer is about 12 micrometers to about 17 micrometers.

5. The anodized aluminum alloy according to claim 1, wherein the anodized aluminum alloy contains greater than 4 weight percent magnesium.

6. The anodized aluminum alloy according to claim 1, further comprising a tin metal electrolytically deposited into the oxide layer.

7. An anodized aluminum alloy comprising:

an aluminum alloy consisting essentially of aluminum and magnesium, wherein the magnesium is in an amount greater than 3 weight percent of the aluminum alloy with a remainder being the aluminum; and a clear porous oxide layer having a thickness greater than about 5 micrometers disposed on an into a surface of the aluminum alloy, wherein the anodized aluminum alloy has a surface gloss value greater than about 40 gloss units as measured on a gloss meter at dual illumination angles of 60° and 85°.

8. A process for anodizing an aluminum alloy, the anodizing process comprising:

immersing an aluminum alloy workpiece comprising greater than 3 weight percent magnesium based on a total weight of the aluminum alloy into an anodizing solution comprising about 10 to about 25 weight percent sulfuric acid maintained at a temperature of about 18° C. to about 22° C.;

applying a first direct electric current density less than or equal to about 5 amperes per square foot for a period of time sufficient to produce an oxide layer at a thickness of at least about 5 micrometers on and into a surface of the aluminum alloy workpiece; and applying a subsequent direct electric current density greater than or equal to about, 10 amperes per square foot for a period of time sufficient to produce a final oxide thickness of about 10 micrometers to about 25 micrometers, wherein the oxide layer is clear and the aluminum alloy workpiece has a gloss value greater than 40 gloss units as measured by a gloss meter at dual illumination angles of 60° and 85°.

9. The anodizing process according to claim 8, wherein the first direct electric current density is than or equal to about 5 amperes per square foot for a period of time less than about 60 minutes, and wherein the subsequent direct electric current density is greater than or equal to about 10 amperes per square foot for a period of time less than about 60 minutes.

10. The anodizing process according to claim 8, wherein applying the first and subsequent direct electric current comprises applying a total amperage minute per square foot of about 300 Amin/ft$^2$ to about 800 Amin/ft$^2$.

11. The anodizing process according to claim 8, wherein applying the first and subsequent direct electric current comprises applying a total amperage minute per square foot of about 400 Amin/ft $^2$ to about 600 Amin/ft$^2$.

12. An anodizing process comprising:

immersing an aluminum alloy wordpiece comprising greater than 3 weight percent magnesium based on a total weight of the aluminum alloy into an anodizing solution comprising about 10 to about 25 weight percent sulfuric acid maintained at a temperature of about 18° C. to about 22° C.;

applying a first direct electric current density to produce an oxide layer at a thickness of at least about 5 micrometers on and into a surface of the aluminum alloy workpiece; and applying a subsequent direct electric current density to produce a final oxide thickness of about 10 micrometers to about 25 micrometers, wherein the first direct electric current density is less than the subsequent direct electric current density, and wherein the oxide layer is clear and the aluminum alloy workpiece has a gloss value greater than 40 gloss units as measured by a gloss meter at dual illumination angles of 60° and 85°.

* * * * *